US006246002B1

(12) United States Patent
Rumsey

(10) Patent No.: US 6,246,002 B1
(45) Date of Patent: Jun. 12, 2001

(54) SHIELDED WIRING SYSTEM FOR HIGH VOLTAGE AC CURRENT

(75) Inventor: Roger L. Rumsey, Wichita, KS (US)

(73) Assignee: Relight America, Inc., Wichita, KS (US)

( * ) Notice: Subject to any disclaimer, the term of this patent is extended or adjusted under 35 U.S.C. 154(b) by 0 days.

(21) Appl. No.: 09/455,185

(22) Filed: Dec. 6, 1999

Related U.S. Application Data

(62) Division of application No. 09/009,168, filed on Jan. 20, 1998, now Pat. No. 5,998,736.

(51) Int. Cl.[7] ..... H01R 4/00
(52) U.S. Cl. ..... 174/84 R; 174/88 C; 174/84 S
(58) Field of Search ..... 174/84 R, 88 C, 174/84 S, 88 S, 65 R, 51; 439/578, 585

(56) References Cited

U.S. PATENT DOCUMENTS

| | | | | |
|---|---|---|---|---|
| 2,245,681 | | 6/1941 | Kenigsberg | 40/130 |
| 3,142,721 | * | 7/1964 | Long | 174/65 |
| 4,328,392 | * | 5/1982 | Kutnyak | 174/68 |
| 4,334,121 | * | 6/1982 | Kutnyak | 174/68 |
| 4,590,950 | * | 5/1986 | Iwaszkiewicz et al. | 128/786 |
| 4,842,535 | | 6/1989 | Velke, Sr. et al. | 439/232 |
| 4,842,548 | * | 6/1989 | Bolante | 439/461 |
| 5,166,477 | | 11/1992 | Perin, Jr. et al. | 174/74 R |
| 5,214,243 | | 5/1993 | Johnson | 174/36 |
| 5,217,392 | * | 6/1993 | Hosler | 439/585 |
| 5,439,386 | | 8/1995 | Ellis et al. | 439/322 |
| 5,645,450 | * | 7/1997 | Yamada et al. | 439/585 |
| 5,722,841 | * | 3/1998 | Wright | 439/98 |
| 5,773,759 | * | 6/1998 | Hablutzel | 174/65 R |
| 5,929,383 | * | 7/1999 | Marik et al. | 174/78 |

* cited by examiner

*Primary Examiner*—Dean A. Reichard
*Assistant Examiner*—William H Mayo, III
(74) *Attorney, Agent, or Firm*—Head, Johnson & Kachigian

(57) ABSTRACT

A shielded wiring system for a high voltage AC current having a flexible cable formed of a central current carrying electrical conductor, a symmetrical layer of insulation concentrically surrounding the central conductor, a symmetrical circumferential layer of shielding conductor surrounding the layer of insulation, and a symmetrical outer sheath of insulation surrounding the shielding conductor, and a connector for connecting the flexible cable to a piece of equipment, the connector having a central electrical conductor and a concentric shield grounded to the piece of equipment, and a short length of bare conductive metal inserted through an opening in the outer sheath of insulation whereby an inner portion conductively engages the shielding conductor and an outer portion engages the concentric shield of the piece of equipment, whereby the symmetrical relationship of a central current carrying conductor within a symmetrical concentric conductive shield providing a concentric and substantially uniform electrostatic field and continuity of ground is maintained throughout the system.

2 Claims, 4 Drawing Sheets

SHIELDED WIRING SYSTEM FOR HIGH VOLTAGE AC CURRENT

REFERENCE TO PENDING APPLICATIONS

This is a divisional application of application Ser. No. 09/009,168 filed Jan. 20, 1998, now U.S. Pat. No. 5,998,736.

This application is not related to any pending applications

REFERENCE TO MICROFICHE APPENDIX

This application is not referenced in any microfiche appendix.

BACKGROUND OF THE INVENTION

This invention relates to a high voltage wiring system for neon lights.

Luminous gaseous signs have been used for may years. While such signs can employ a variety of gases, the most popular and effective signs use neon gas and are referred to as "neon signs". Neon signs are typically formed of glass tubing that is evacuated of substantially all of the air therein and refilled with neon gas. A conductive probe is inserted into each of the opposed ends of the tube. When high voltage energy is applied to the opposed ends of a neon filled tube, the neon gas is excited and produces visible electromagnetic radiation. The glass tubes can be of varying diameters and can easily be conformed to replicate letters, numbers and designs. The visible spectrum of light provided by excited neon gas is relatively bright and attractive; therefore the use of neon signs has become exceedingly popular in the United States and other countries of the world.

A serious problem that arises with the use of neon signs is the danger of fire and high voltage shock to workman who install or repair them. The typical neon sign transformer in the United States can be powered by standard household current, that is, 120V 60 Hz AC but the voltage typically supplied by the transformer and applied to neon signs is approximately 15,000V 60 Hz AC. This high voltage is dangerous to workman and any other living organism that may come in contact with the wiring for the neon sign. Further, this high voltage is also frequently the cause of building fires. Fifteen thousand volts AC readily arcs across adjacent conductors or from a conductor to a ground and such arcing can ignite combustible materials. The danger of fire as a consequence of this high voltage has become of such concern that many municipalities discourage the use of neon signs. In some cases, neon signs are being replaced by other types of signs that do not require high voltage electrical current.

Others have provided electrical fittings and wiring systems that are useful to supply high voltage electrical current, such as for connecting neon signs. For background information relating to other system, reference may be made to the following United States patents:

| U.S. PAT. NO. | INVENTOR | TITLE |
|---|---|---|
| 2,245,681 | Kenigserg | Interchangeable Unit Luminous Gaseous Sign |
| 4,842,535 | Velke, Sr. et al | Gas Tube Electrode Connector |
| 5,166,477 | Perin, Jr. et al | Cable and Termination For High Voltage and High Frequency Applications |

-continued

| U.S. PAT. NO. | INVENTOR | TITLE |
|---|---|---|
| 5,214,243 | Johnson | High-Temperature, Low-Noise Coaxial Cable Assembly With High Strength Reinforcement Braid |
| 5,439,386 | Ellis et al | Quick Disconnect Environmentally Sealed RF Connector For Hardline Coaxial Cable |

BRIEF SUMMARY OF THE INVENTION

The invention is concerned with a wiring system, including cables and male, female and pass-through connectors for transferring high voltage electrical AC current from a high voltage power source to a neon sign. The typical high voltage transformer may, as and example, employ a primary activated by 120V 60 Hz AC as is commonly used in the United States for commercial establishments. The transformer concerts the 120V 60 Hz AC electrical energy into high voltage 60 Hz electrical energy typical in the range of approximately 15,000 volts. This disclosure provides a convenient and easily installed system for safely conducting high voltage to individual segments of a neon sign.

This invention is basically concerned with a wiring system for a neon light by which a high voltage AC current is transported from a two pole high voltage transformer to a neon light, one pole of the transformer being at ground potential and the other pole of the transformer being at a high AC voltage relative to ground. The system employs a flexible cable having in cross-section, (a) a central current carrying electrical conductor; (b) a symmetrical layer of insulation concentrically surrounding the central conductor; and (c) a symmetrical circumferential layer of shielding conductor surrounding the layer of insulation. The cable may also, optionally, have an outer layer of plastic or rubber insulation.

The system further includes at least one connector for connecting a length of the flexible cable to another piece of equipment, the connector providing a central electrical conductor in another piece of equipment and said shielding conductor of said cable to a shielding conductor of another piece of equipment whereby the symmetrical relationship of a central current carrying conductor within a symmetrical concentric shielding conductor is maintained in the cable system so that a concentric and substantially uniform electrostatic field is maintained throughout the cable system.

An important feature of the system is a method of passing high voltage wiring through a wall having an opening therethrough and an interior and exterior surface. A short length cylindrical pass-through body has a nominal external diameter less than that of the opening. The pass-through body has a first end and second end. Adjacent the first end of the pass-through body is an integral enlarged external diameter flange. A recess is formed in the pass-through body second end. A reduced external diameter integral tubular extension is provided at the pass-through body first end in axial communication with the recess. External threads are provided on the exterior of the pass-through body, the threads extending from the flange to the body second end. A coaxially insulated conductor is received within the tubular extension and within the recess to thereby extend through the pass-through body. A ground shield connection from the coaxial cable is centered within the recess formed within the body. The tubular extension of the body is then crimped (compressed) to make permanent contact with the ground shield connection and also to form strain relief for the completed cable system.

An externally threaded nut is threadably positioned on the pass-through body external threads. The flange engages one wall surface and the nut engages the other wall surface to retain the pass-through body within the opening and to ground the pass-through to the wall, thereby providing a safe and secure means of extending high voltage electrical energy through the wall, whether the wall be a portion of a sign, a portion of a building or an opening in a metal housing contain either a sign or high voltage transformer, while maintaining uniform field strengths and ground through out the total length of cable length.

The invention further includes a second apparatus for making a positive electrical connection with a mating male apparatus. This apparatus consists of a member of tubular conducting material that is externally threaded on both ends. The threading first end is of smaller diameter than the second flange end threading. An insulating flange tubular member is designed to fit within the tubular conducting member. The first end of this member is designed with an integral to flange that eliminates this member from passing through the conducting member.

A member of tubular conducting material is internally threaded on one end. This threaded area is designed to be threaded onto the smaller diameter threaded area of another tubular member of conduction material.

A first portion of a metallic electrical connector 12 is telescopically positioned within the tubular female insulating body and is connected to the conductor of a power cable. An internally threaded nut may be threaded onto the larger diameter threads to allow use as a pass-through. The exterior and interior surfaces of this apparatus are configured to removably interlock with the apparatus.

The second portion of this apparatus consists of a member of tubular conducting material that is externally threaded on one end and the opposing end has an larger diameter integral flange. An insulating flange tubular member is designed to fit within the tubular conducting member. The first end of this member is designed with and integral flange that eliminates this member from passing through the conducting member. A member formed of tubular conducting material is internally threaded on one end. This threaded area is designed to be threaded onto the externally threaded end of the other tubular member of conducting material.

A second portion of a metallic electrical conductor is telescopically positioned within the tubular female insulating body and is connected to the conductor of a power cable unit. A tubular conducting material is internally threaded on one end and has an internally flange on the second end. The internally threaded area is designed to mate with the external threads of the first portion.

A better understanding of the invention will be obtained from the following description of the preferred embodiments and the claims, taken in conjunction with the attached drawings.

DETAILED DESCRIPTION OF THE PREFERRED EMBODIMENTS

Figure 1:
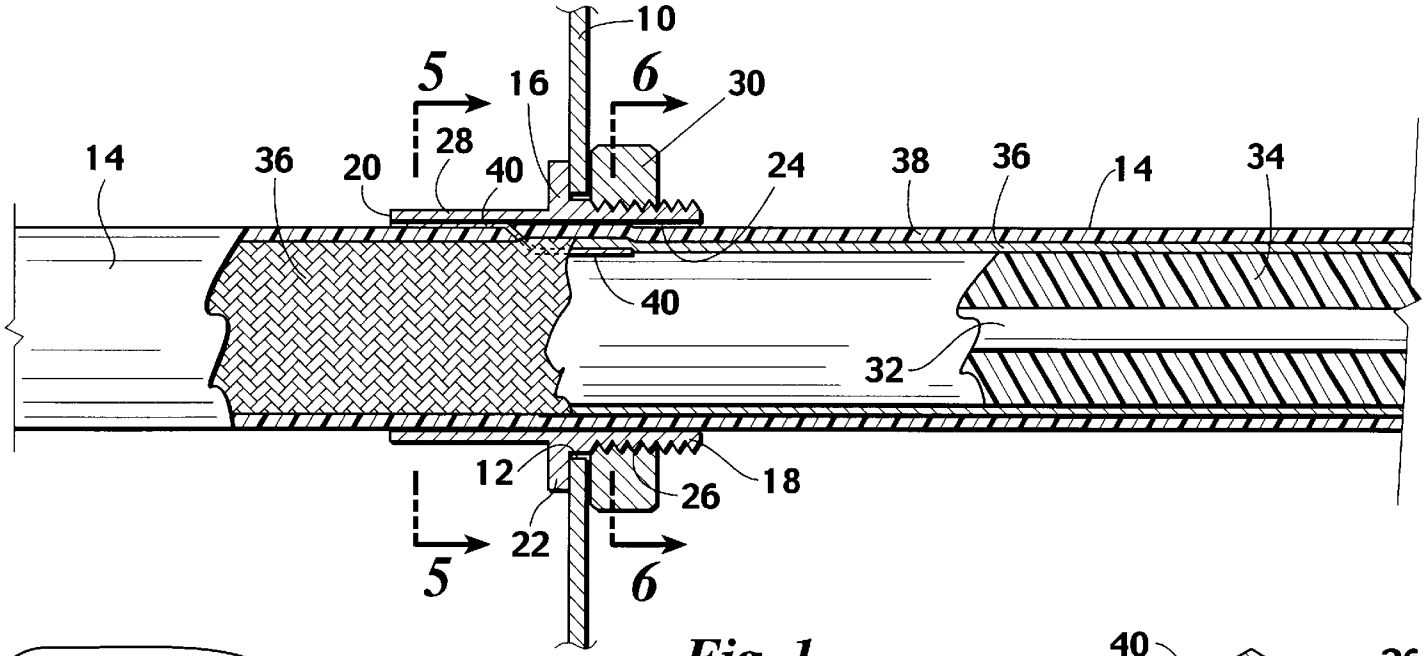
FIG. 1 is an elevational cross-sectional enlarged view of a pass-through, showing the means of passing a high voltage power cable through an opening in a metal wall.
Figure 6:
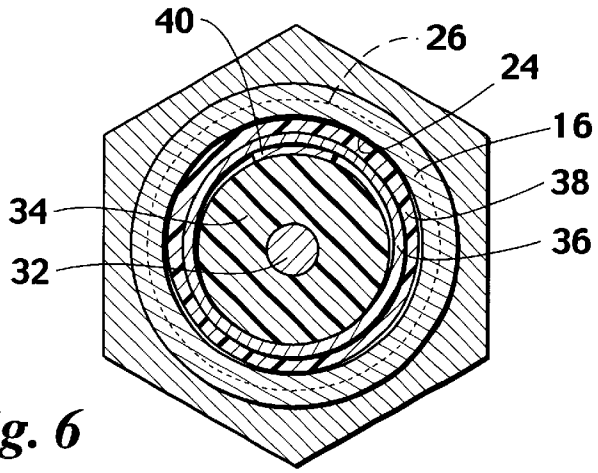
FIG. 6 is an elevational cross-sectional view of the pass-through as taken along the line 6—6 of FIG. 1.
Figure 5:
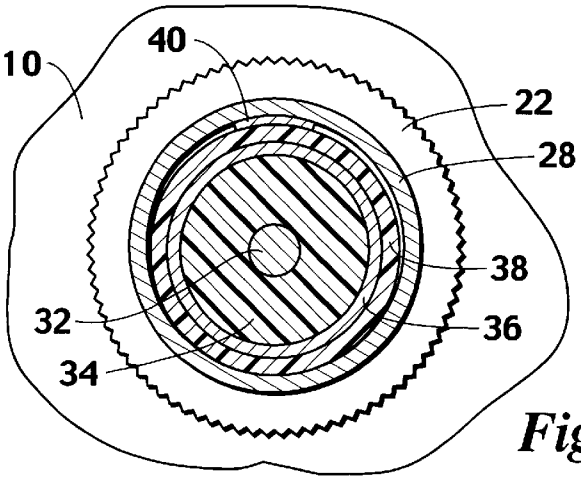
FIG. 5 is an elevational cross-sectional view of the pass-through as taken along the line 5—5 of FIG. 1.

This invention is concerned with a system for use in neon power cabling for transferring high voltage electrical energy from a high voltage source, typically a transformer, to one or more electrical energy consuming devices, such as neon light tubes. FIG. 1 illustrates one embodiment of the system of this invention that employs a pass-through assembly that is useful for passing high voltage electrical energy through a wall and illustrates a means of providing electrical continuity and electromagnetic field shield continuity through the wall. The device when installed as shown in FIG. 1 also insures that a positive ground path is established. FIG. 1 shows a support wall 10 of an energy producing or consuming device. Wall 10 has an opening 12 therein. The objective is to pass-through opening 12 a cable 14 in a way to maintain a substantially uniform electromagnetic field and insure a positive ground path from support wall 10 to cable 14.

Received within opening 12 is a pass-through fitting 16 having a first end 18, a second end 20, an intermediate flange section 22 and a central opening 24 extending therethrough. Integral outwardly extending flange 22 separates the first end portion and the second end portion of the fitting. External threads 26 are formed on the fitting body extending from flange 22 to first end 18. Integrally extending from flange 22 is a reduced external diameter tubular portion 28. To retain pass-through fitting 16 within opening 12, nut 30 is employed. Wall 10 is captured between flange 22 and nut 30.

Cable 14 received within tubular opening 24 includes a central conductor 32 having inner insulation 34 thereon, the insulation being surrounded by a metallic woven jacket 36. An outer insulating sheathing 38 surrounds the metallic woven jacket.

Received within and upon cable 14 is a U-shaped ground/shield connection 40. Ground/shield connection 40 is positioned within tubular opening 24 and adjacent first end 20 of fitting 16. After cable 14 and ground/shield connection 40 are placed in opening 24 as shown in FIG. 1, tubular portion 28 is compressed by means of crimping. Crimping of tubular portion 28 of fitting 16 provides a positive electrical connection between the fitting and cable ground/shield 40 and provides positive strain relief for the cable relative to wall 10.

Further, and of most significance, ground shield connection 40 electrically grounds metallic jacket 36 of cable 14 to pass-through fitting 16 and thereby to wall 10.

Figure 2:
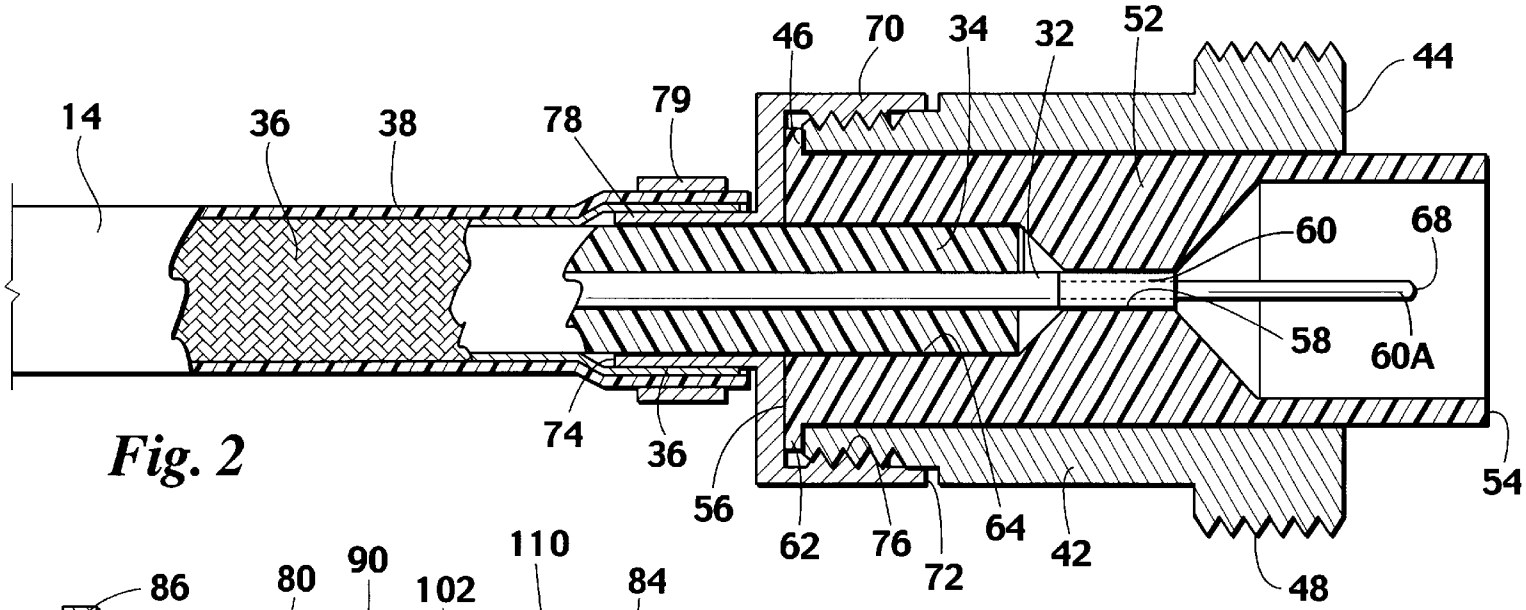
FIG. 2 is an enlarged, elevational cross-sectional view of a female coupling for use in a high voltage wiring system.
Figure 3:
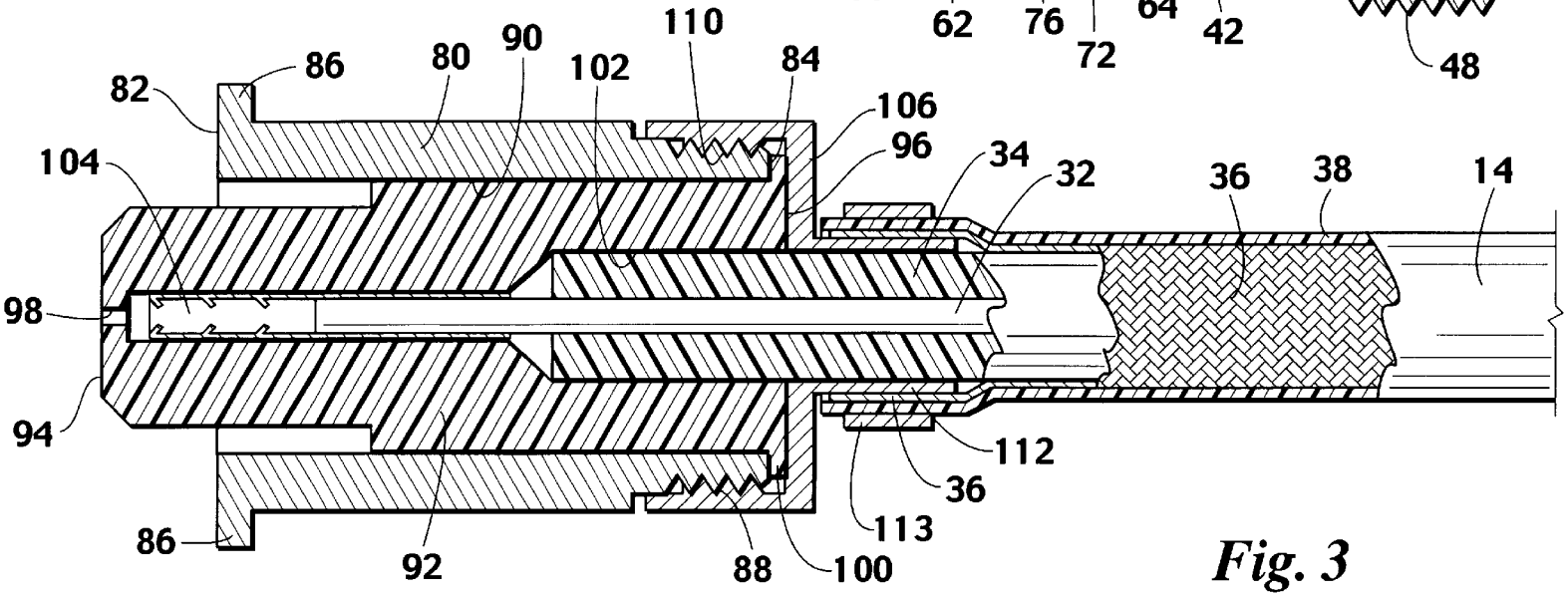
FIG. 3 is an enlarged, elevational cross-sectional view of a male coupling for use with the female opening of FIG. 2 in a high voltage wiring system.
Figure 4:
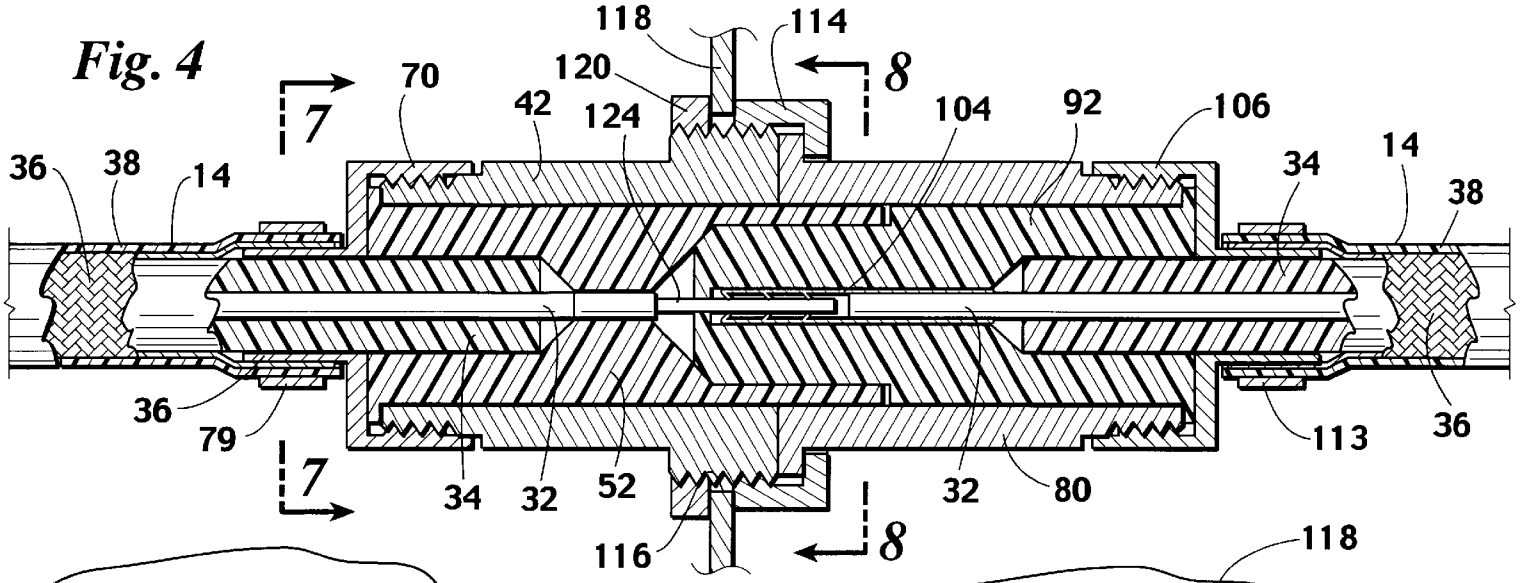
FIG. 4 is an elevational cross-sectional enlarged view of a female coupling and a male coupling connected together, showing means in which conductor and ground shield continuities are maintained.
Figure 8:
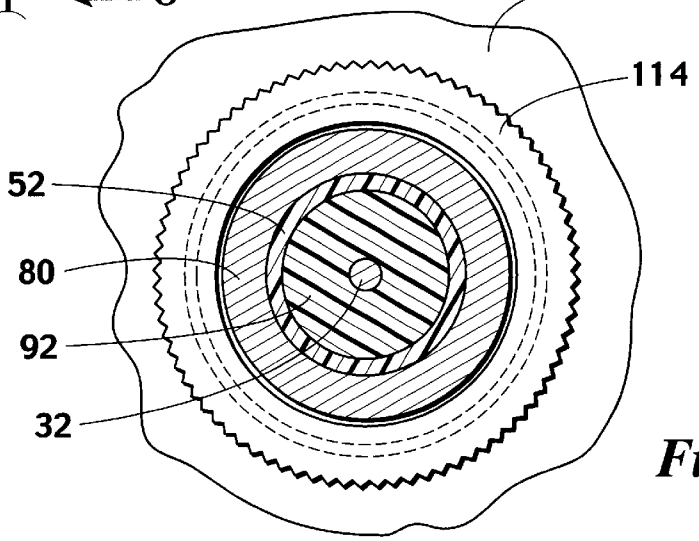
FIG. 8 is an elevational cross-sectional view as taken along the line 8—8 of FIG. 4.
Figure 7:
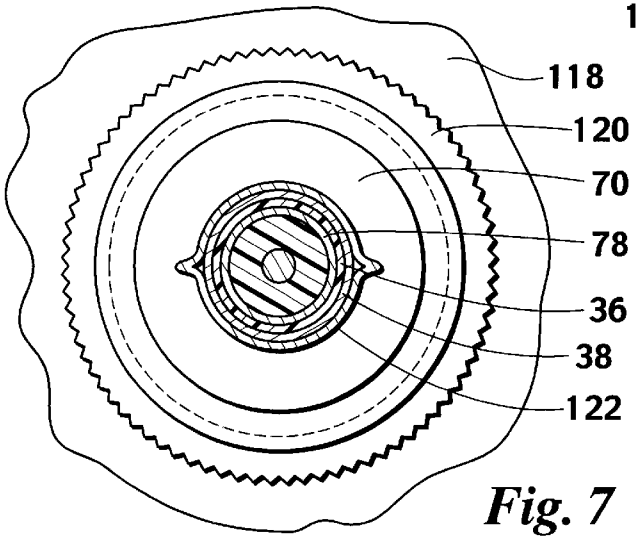
FIG. 7 is an elevational cross-sectional view as taken along the line 7—7 of FIG. 4.

FIGS. 2 through 4 illustrate a cable connector in the form of a male and female connector. The female portion of the connector, illustrated separately in FIG. 2, will be the first described. This portion of the connector consists of an elongated generally tubular body 42 of conducting material, such as metal. Body 42 has a first end 44 and a second end 46. The first end 44 has the largest outside diameter of body 42. External threads 48 are formed at the first end 44 of body 42. The second end 46 has the smallest outside diameter of body 42. External threads 50 are formed at second end 46. Body 42 has a central opening extending therethrough.

A second portion of the female connector consists of an elongated generally tubular body 52 of non-conductive material, such as plastic. Body 52 has a first end 54, a middle section and a second end 56. The first end 54 has an enlarged tubular opening to receive a male body to be described subsequently. A tubular middle section 58 has a reduced internal diameter extending therethrough. The tubular section is of size to receive a connector element 60 that has an elongated, reduced diameter rod portion 60A. The second end 56 of tubular body 52 incorporates an integral outwardly extending flange 62. Second end 56 has a tubular opening 64 to receive the central portion of cable 14.

Connector element 60 is a commercially available product that telescopically extends over an end of cable conductor 32 and has integrally extending from it the reduced diameter rod portion 60A terminating in an outer end 68. Connector element 60 is designed to be inserted within section 58 of tubular body 52 and to be retained therein.

The female connector of FIG. 2 includes an elongated generally tubular body 70 of conducting material, such as metal. Body 70 has a first end 72 and a second end 74. Internal threads 76 are formed at first end 72 to threadably engage the external threads at the second end 46 of tubular body 42. Integrally extending from member 70 is a reduced external diameter tubular portion 78.

Received within tubular portion 78 of tubular body 70 and within opening 64 in tubular body 52 is inner insulation 34 and conductor 32 of cable 14. Metallic woven jacket 36 and outer insulation sheathing 38 of cable 14 are positioned over tubular portion 78 of tubular body 70. Metal jacket 36 is forced into electrical contact with tubular body 72 by means of a band 79 so that electrical continuity is provided between conductor metal jacket 36 and female metallic fitting portions 70 and 42. Further, band 79 provides positive strain relief for cable 14.

The female connector shown in FIG. 2 can be used to pass-through a wall having an opening therein dimensioned to receive threaded portion 48. Two nuts (not shown) can then be secured on threaded portion 48 to either side of a metal wall (not shown) to thereby attach the connector to the wall.

The male portion of the connector will now be described with reference to FIG. 3 and includes an elongated generally tubular body 80 of conducting material such as metal, having a first end 82 and a second end 84. First end 82 has an outwardly extending flange 86. Adjacent second end 84 are external threads 88. Body 80 has an internal opening 90 extending therethrough.

The male connector includes an elongated generally tubular body 92 of non-conductive material, such as plastic. Body 92 has a first end 94 and a second end 96. The portion adjacent end 94 has a reduced outer diameter and a small diameter central opening 98. Second end 96 incorporates an integral outwardly extending flange 100. A concentric opening 102 in tubular body 92 receives inner insulation 34 and conductor 32 of cable 14. A commercially available connector element 104 is attached to the outer end of conductor 32.

A generally tubular body 106 of conducting material, such as metal, has internal threads 110 that engage threads 88 of body portion 80. Flange portion 100 of insulation body 92 is captured between end 96 of connector body portion 80 and tubular body 106. Integrally extending from tubular body 106 is reduced external diameter tubular portion 112.

Received within tubular portion 112 is conductor 22 and inner insulation 34 that are portions of cable 14. Metallic woven jacket 36 and outer insulation sheathing 38 are positioned on the exterior of tubular portion 112. Positioned on the exterior of outer insulation 38 of cable 14 is a clamping band 113 that is like clamping band 79 on the female connector. The clamping band insures a positive electrical connection between cable metallic jacket 36 and connector tubular portion 113 and thereby to tubular body 80.

FIG. 4 illustrates the engagement of the female connector of FIG. 2 with the male connector of FIG. 3 and also shows the male and female connector portions serving as a pass-through fitting. A closure nut 114 engages external threads 48 of the female connector portion to provide a positive ground path between the female and male portions of the connector. Further, a concentric electromagnetic shield is maintained around the current carrying path through the connector.

The assembled male and female connector portions as shown in FIG. 4 joins two lengths of cables while maintaining concentric electromagnetic shielding around the central current carrying cable conductors. In FIG. 4 the assembled connector is also used as a pass-through connector by which a high voltage current carrying system is passed through an opening 116 is a metal wall 118. A back up nut 120 locks the assembled connector to metal wall 118. When the assembled connector is used only to couple together two lengths of shielded cable back up nut 120 is not required.

Figure 9:
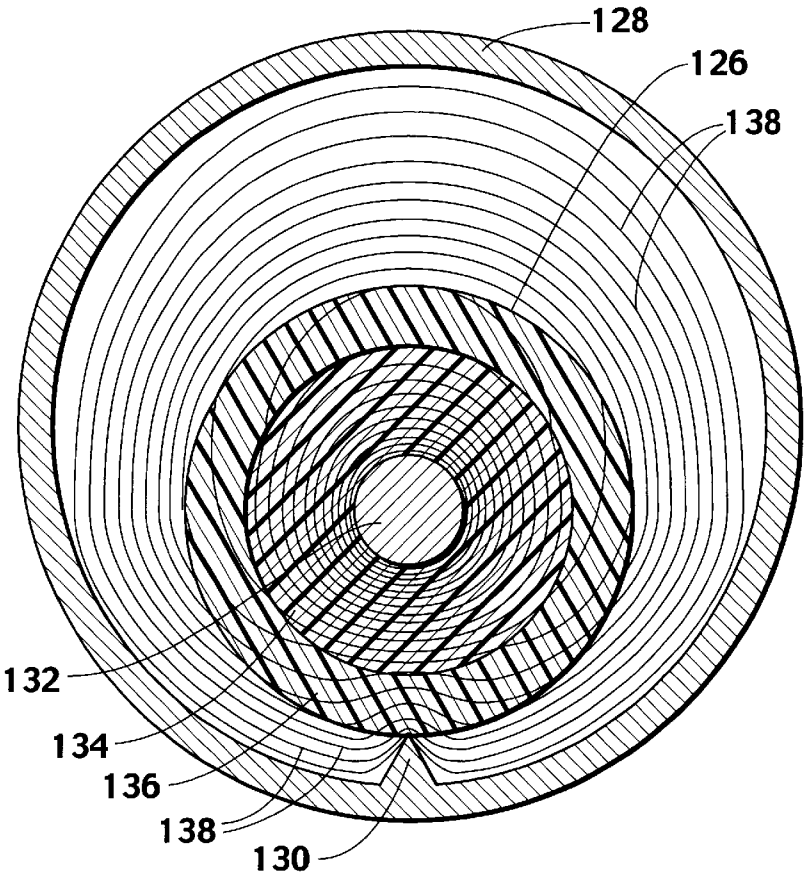
FIG. 9 is a cross-sectional view of an insulated high voltage cable positioned within a metal conduit, such as a flexible metal conduit in which the conduit has an irregular interior surface. This figure illustrates the electric field surrounding the insulated high voltage cable and shows how the field potential can be by an external ground to thereby potentially cause arcing from the cable conductor through the cable insulation which can result in shorting of the conductor and therefore represents a potential fire hazard.

As previously indicated, a critical aspect of this invention is an improved high voltage wiring system, particularly adaptable for connecting neon lights, that contains the electric fields substantially within the confines of a metallic jacket that surrounds the current carrying conductor in a cable to substantially reduce the possibility of the concentrations of lines of electric field potential that could result in arcing between the conductor and an adjacent ground point. Referring now to FIG. 9, a high voltage non-shielded cable 126 is shown positioned within a conduit 128. Conduit 128 may be of the rigid type or of the flexible type usually formed of spirally wound interlocking metal segments. Whether of the rigid or flexible type, conduit 128 is metal and is at ground potential and is shown to include an internal protrusion or ground point 130. Ground point 130 may be such as a ridge formed by interlocking segments when the conduit 128 is flexible and is representative of any change in the interior of conduit 128 which causes the conduit to be non-symmetrical in cross-section with respect to a current carrying conductor 132 that is centrally contained within cable 126. Cable 126 further includes primary insulation 134 and secondary insulation 136, both insulation layers 134 and 136 are typically formed of plastic but may be of fiberglass, asbestos or of any flexible non-conductive material. When conductor 132 is subjected to a high voltage, such as a voltage required for neon signs, an electric field is established surrounding conductor 132, the electric field being indicated by lines of equal potential 138.

When a conductive anomaly occurs within an electric field, there is a tendency for field potential to concentrate at the non-conformity as illustrated in FIG. 9 wherein the field strength lines illustrate the concentration of the electric field potential at ground point 130. This area of field strength concentration can result in a potential sufficient to cause arcing to occur between conductor 132 and ground point 130. This phenomena is well known and is the basis for the design of lightning protector systems in which a pointed metal conductor (lightening rod) is positioned on a building. A lightening rod causes an electric field in the vicinity to be concentrated at the protector so that if lightening strikes in the vicinity it is likely to strike the lightening rod, and thereby protect the building. The phenomena of the concentration of electric field potential surrounding a high voltage wire appears to be responsible for the problems of arcing and resultant shortings of electric circuits and accompanying fire hazards that have been frequently encountered with neon sign wiring.

Figure 10:
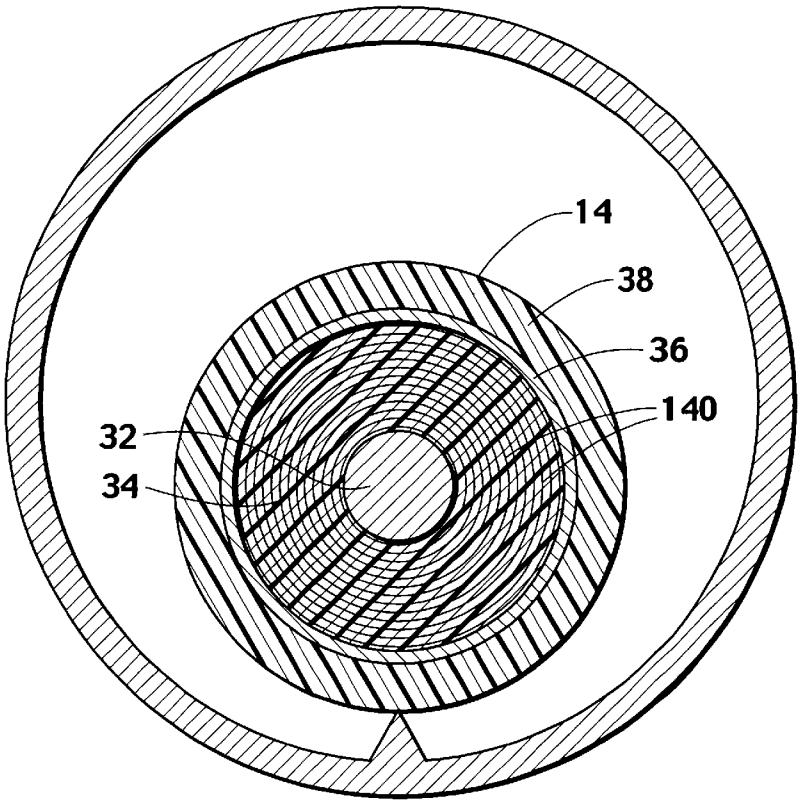
FIG. 10 is a cross-sectional view as shown in FIG. 9 showing a high voltage cable within a conduit, such as flexible conduit, but illustrating the system of this invention wherein the high voltage cable is provided with a metallic jacket as disclosed in FIGS. 1 through 8. This figure illustrates the way in which the metal jacket serves to restrain the electrical field concentric to the cable conductor to thereby eliminate or, at least substantially greatly reduce the concentration of field potential at an exterior ground point to thereby reduce the possibility of arcing between the cable conductor and a ground point to thereby reduce the fire hazard potential.

FIG. 10 shows the arrangement of this invention wherein the high voltage non-shielded cable of FIG. 9 is replaced by a shielded cable 14 of the type that has been described and illustrated with respect to FIGS. 1 through 8. Shielded cable 14 has a central current carrying conductor 32, usually of copper, surrounded by a layer of primary insulation 34 which in turn is surrounded by a metallic jacket 36. Exterior of metallic jacket 36 is an outer secondary layer of insulation or sheeting 38. The provision of the shielding in cable 14, that is, particularly the provision of a metallic jacket 36 that concentrically surrounds conductor 32 results in a substantially uniform electric field surrounding the cable. With a substantially uniform electric field that is substantially confined within metallic jacket 36, the possibility of an electric field concentration with a ground point is greatly reduced. Stating it another way, by maintaining concentric and uniform spacing between high voltage current carrying conductor 32 and the most adjacent ground, that is, the metallic jacket 36, the possibility of arcing and resulting shorting of the wiring system is substantially reduced.

As seen in FIG. 10, the lines of electric field potential 140 are concentric about conductor 132 and concentric within metallic jacket 136 so that no point of concentration of the electric field is established.

By arranging a high voltage wiring system for neon signs wherein the electric field is maintained concentric to the high voltage conductor throughout the system and wherein the possibility of a point of concentration of the electric field is eliminated or at least substantially minimized, the possibility of failure of the wiring system is greatly reduced. The pass-through connector of FIG. 1 and the connector system as described and illustrated with reference to FIGS. 2, 3 and 4, taken in conjunction with the cross-sectional views 5 through 8, demonstrate how a system can be constructed so that throughout the entire system, including connections, pass-throughs and so forth, lines of electric field force are concentrically maintained. Thus, the possibility of failure of the high voltage wiring system for a neon sign is substantially reduced.

The lines of field strength 138 in FIG. 9 and 140 in FIG. 10 are representative and are not intended to reflect actual measurements but are based on tests conducted utilizing high voltage conductors that demonstrate the increased likelihood of arcing between an insulated (non-shielded) conductor and an adjacent metal ground anomaly that is substantially reduced when a shielded conductor system is utilized.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A shielded wiring system for high voltage AC current comprising;

a flexible cable having a central current carrying electrical conductor, a symmetrical layer of insulation concentrically surrounding said central conductor, a symmetrical circumferential layer of shielding conductor surrounding said layer of insulation and a symmetrical outer sheath of insulation surrounding said shielding conductor;

a fitting of conductive material having a passageway therethrough that receives said flexible cable therein, said fitting having at one end thereof an integral portion for use in attachment of the fitting to another piece of electrically conductive equipment and having at an opposite end thereof an integral crimpable thin wall tubular portion providing a portion of said passageway that receives said cable; and a short length flat bare conductive metal insert having a first portion positioned through a relatively small opening in an otherwise uninterrupted portion of said flexible cable outer sheath of insulation to conductively engage said cable circumferential layer of shielding conductor and having a second portion that remains exterior of said uninterrupted portion of said flexible cable outer sheath of insulation that conductively engages said fitting whereby said fitting is in electrical continuity with said cable circumferential layer of shielding conductor, said second portion of said conductive metal insert engaging said fitting integral reduced external diameter tubular portion and said fitting integral reduced external diameter tubular portion being readily inwardly compressed by means of crimping to thoroughly contact said conductive metal insert second portion to thereby ground said fitting to said cable circumferential layer of shielding conductor.

2. A shielded wiring system for high voltage A/C current according to claim 1 wherein said integral portion of said fitting for use in attachment of the fitting to another piece of electrically conductive equipment is externally threaded.

* * * * *